US009038534B2

(12) United States Patent
Gilan et al.

(10) Patent No.: US 9,038,534 B2
(45) Date of Patent: May 26, 2015

(54) EMBOSSING MEDIA

(71) Applicant: HEWLETT-PACKARD INDIGO B.V., Amstelveen (NL)

(72) Inventors: Ziv Gilan, Nes Ziona (IL); Gadi Oron, Nes Ziona (IL); Elkan Jhirad, Nes Ziona (IL); Eyal Shelef, Nes Ziona (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 200 days.

(21) Appl. No.: 13/715,379

(22) Filed: Dec. 14, 2012

(65) Prior Publication Data

US 2014/0165861 A1 Jun. 19, 2014

(51) Int. Cl.
*B44B 5/02* (2006.01)
*B44B 5/00* (2006.01)

(52) U.S. Cl.
CPC ..... *B44B 5/0095* (2013.01); *B44B 5/0004* (2013.01); *B44B 5/0052* (2013.01)

(58) Field of Classification Search
CPC .. B44B 5/0009; B44B 5/0047; B44B 5/0095; B44B 5/02; B41F 19/02; B41F 19/06; B41F 19/062; B41F 1/07; B41M 1/24
USPC ..... 101/25, 32, 18, 23, 29, 28, 33, 34, 5, 101/16, 3.1; 162/362; 156/762
See application file for complete search history.

(56) References Cited

U.S. PATENT DOCUMENTS

| | | | | |
|---|---|---|---|---|
| 6,645,602 | B2 | 11/2003 | Gerber | |
| 6,832,547 | B2 | 12/2004 | Makoui et al. | |
| 6,962,640 | B2 | 11/2005 | Mäker et al. | |
| 7,717,035 | B1 | 5/2010 | Gray | |
| 8,192,098 | B1 * | 6/2012 | Olsen | 400/171 |
| 2008/0290647 | A1 * | 11/2008 | Adamczyk et al. | 283/72 |
| 2010/0313779 | A1 * | 12/2010 | Scarfe | 101/477 |
| 2011/0217149 | A1 * | 9/2011 | Ward et al. | 414/224.01 |

FOREIGN PATENT DOCUMENTS

| | | | |
|---|---|---|---|
| WO | 2005109325 | A2 | 11/2005 |
| WO | 2008092650 | A2 | 8/2008 |

* cited by examiner

*Primary Examiner* — Daniel J Colilla
*Assistant Examiner* — Ruben Parco, Jr.

(57) ABSTRACT

Apparatus for embossing media, the apparatus including cutter apparatus to cut a shape in a surface layer of a multi-layer substrate to form a die. The apparatus also includes an embosser to emboss the media using the die. The cutter apparatus is arranged to provide the die to the embosser.

14 Claims, 5 Drawing Sheets

EMBOSSING MEDIA

BACKGROUND

Printing systems include a printer for printing on a sheet or web of media (such as paper). In some instances, the printed media may be provided to a separate embossing device that embosses the printed media. However, the embossing device may be unsuitable for embossing a small quantity of media due to the time required for creating a dedicated die for the desired embossing shape and the associated cost of creating the die.

BRIEF DESCRIPTION

Reference will now be made by way of example only to the accompanying drawings in which.

DETAILED DESCRIPTION

Figure 1:
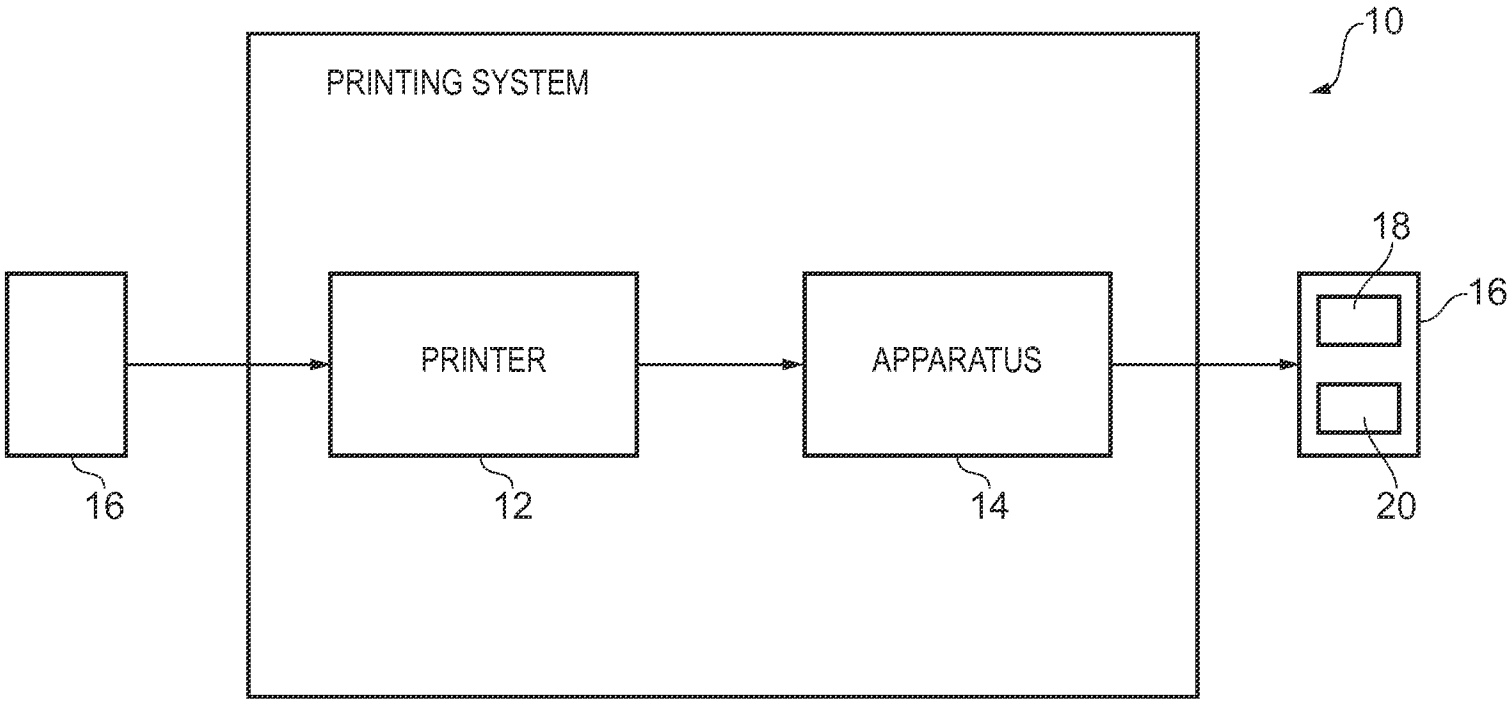
FIG. 1 illustrates a schematic diagram of a printing system according to an example.

FIG. 1 illustrates a schematic diagram of a printing system 10 according to an example. The printing system 10 includes a printer 12 and an apparatus 14 for embossing media. The printing system 10 may include a single housing for housing the printer 12 and the apparatus 14. In other examples, the printer 12 and the apparatus 14 may have separate housings.

The printer 12 may be any suitable printer for printing text and/or graphics on a sheet or web of media 16 and may be, for example, an inkjet printer or a laser printer. The printer 12 is arranged to receive a sheet or web of media 16 (such as paper), print on the media 16 and then provide the media 16 to the apparatus 14.

The apparatus 14 is arranged to receive the printed media 16 from the printer 12 and emboss the media 16. As used in this patent application, 'embossing' includes any impression made on the media 16 that changes the surface texture of the media 16. For example, 'embossing' includes forming creases in the media 16.

The apparatus 14 is arranged to provide the embossed printed media 16 to a user of the printing system 10 or to a further component (not illustrated) of the printing system. As illustrated in FIG. 1, the embossed printed media 16 includes a printed portion 18 and an embossed portion 20 which may not overlap, may partially overlap, or may wholly overlap. In some examples, the embossed printed media 16 may include a plurality of printed portions 18 and a plurality of embossed portions 20 which may not overlap, may partially overlap, or may wholly overlap.

The printing system 10 may include further components not illustrated in FIG. 1. For example, the printing system 10 may additionally include a module for coating the media 16 with a pre-printing treatment (such as primer) and/or a module for coating the media 16 with a post-printing treatment (such as varnish).

The apparatus 14 for embossing media 16 is described in the following paragraphs with reference to FIGS. 2 to 5.

Figure 2:
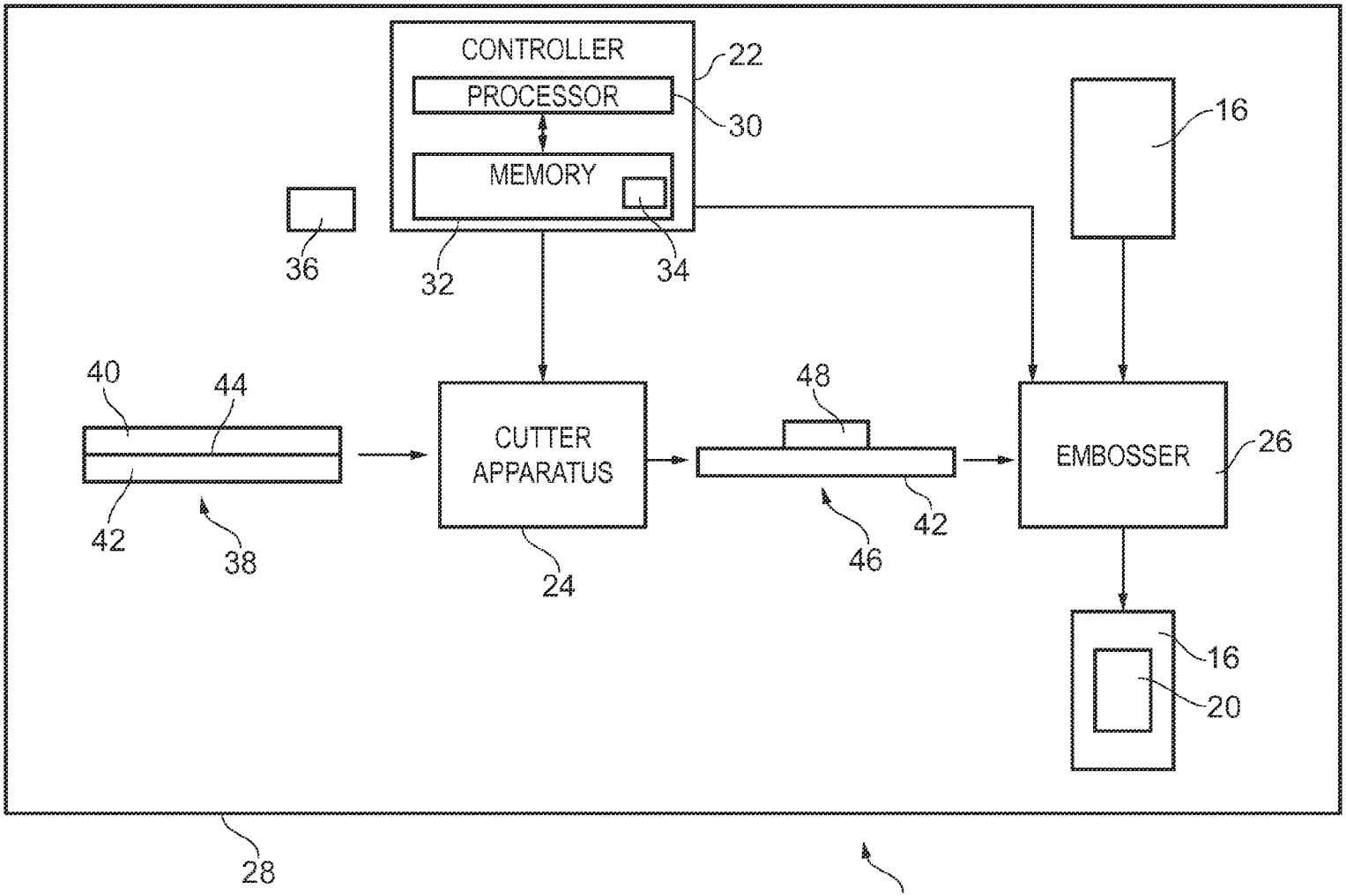
FIG. 2 illustrates a schematic diagram of an apparatus for embossing media according to an example.

FIG. 2 illustrates a schematic diagram of an apparatus 141 for embossing media according to an example. The apparatus 141 includes a controller 22, cutter apparatus 24, an embosser 26 and a housing 28. The apparatus 141 may be a unitary device whereby the controller 22, the cutter apparatus 24, the embosser 26 are housed in the housing 28 and form a standalone device that may be connected to the printer 12 illustrated in FIG. 1. In other examples, the housing 28 may house both the apparatus 141 and the printer 12. In further examples, the apparatus 141 may be a module. As used in this patent application, 'module' refers to a unit or apparatus that excludes certain parts/components that would be added by an end manufacturer or a user. For example, the apparatus 141 may not include the controller 22 and/or the housing 28.

The implementation of the controller 22 can be in hardware alone (for example, a circuit, a processor and so on), have certain aspects in software including firmware alone or can be a combination of hardware and software (including firmware).

The controller 22 may be implemented using instructions that enable hardware functionality, for example, by using executable computer program instructions in a general-purpose or special-purpose processor 30 that may be stored on a computer readable storage medium 32 (disk, memory etc) to be executed by such a processor 30.

The processor 30 is configured to read from and write to the memory 32. The processor 30 may also comprise an output interface via which data and/or commands are output by the processor 30 and an input interface via which data and/or commands are input to the processor 30.

The memory 32 stores a computer program 34 comprising computer program instructions that control the operation of the apparatus 141 when loaded into the processor 30. The computer program instructions 34 provide the logic and routines that enables the apparatus to perform at least a portion of the method illustrated in FIG. 5. The processor 30 by reading the memory 32 is able to load and execute the computer program 34.

The computer program may arrive at the apparatus 141 via any suitable delivery mechanism 36. The delivery mechanism 36 may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 34. The delivery mechanism 36 may be a signal configured to reliably transfer the computer program 34. The apparatus 141 may propagate or transmit the computer program 34 as a computer data signal.

Although the memory 32 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analogue and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware.

The cutter apparatus 24 may include any suitable cutter for cutting a multi-layer substrate 38 and may include, for example, a laser or a knife. The cutter apparatus 24 is arranged to receive the multi-layer substrate 38 from a dispenser (not illustrated in this figure). The multi-layer substrate 38 is a sheet or a web and includes at least a first layer 40 and a second layer 42 that are coupled to one another by an adhesive 44.

The cutter apparatus 24 is arranged to cut a shape in at least a surface layer of the multi-layer substrate 38 (the first layer 40 in this example) to form a die 46. In some examples, the multi-layer substrate 38 may include more than two layers and the cutter apparatus 24 may be arranged to cut a shape in a plurality of layers to form the die 46. The cutter apparatus 24 may also be referred to as a 'die former' that is arranged to selectively remove a portion of at least a surface layer of the multi-layer substrate 38. In some examples, the die former 24 includes a collector that is arranged to remove the portion of the surface layer after it has been cut. In other examples, the die former 24 comprises a laser that is arranged to remove the portion of the surface layer by burning off the portion of the surface layer.

The die 46 includes the second layer 42 and a portion 48 of the first layer 40 having the shape cut by the cutter apparatus 24. The portion 48 may have any shape (including any pattern) depending on the cutting technology to produce a desired embossing effect on the media 16. In some examples, the cutter apparatus 24 may cut a plurality of shapes in the first layer 40 of the multi-layer substrate 38 to form a die 46 having a plurality of portions 48.

The cutter apparatus 24 is arranged to provide the die 46 to the embosser 26. In some examples, the cutter apparatus 24 may include an actuator (such as a roller) for providing the die 46 to the embosser 26. In other examples, the cutter apparatus 24 may provide the die 46 to the embosser 26 by being positioned adjacent the embosser 26 and the embosser 26 includes an actuator for removing the die 46 from the cutter apparatus 24. Consequently, no direct human intervention may be required for moving the die 46 from the cutter apparatus 24 to the embosser 26.

The controller 22 is arranged to control the operation of the cutter apparatus 24. In particular, the controller 22 is arranged to receive data defining the shape to be cut in the multi-layer substrate 38. The controller 22 may receive the data from a user controlling a user input device (not illustrated) to generate the shape data. In other examples, the memory 32 may store the shape data and the controller 22 may receive the shape data from the memory 32. For example, the area to be embossed may also be defined in a PDF file or other suitable print job file. The controller 22 is arranged to control the cutter apparatus 24 to cut the shape in the first layer 40 using the received shape data.

The embosser 26 is arranged to emboss the media 16 using the die 46 and may have any suitable structure. For example, the embosser 26 may include opposing pressure rollers that form a nip there between. The embosser 26 may also be referred to as a 'pressure applicator'. As the media 16 and the die 46 move through the nip, the opposing pressure rollers press the die 46 into the media 16 causing the media 16 to become embossed (as indicated by reference numeral 20). In other examples, the embosser 26 may include a conveyer belt and an opposing pressure drum, or may include opposing conveyer belts that press the die 46 into the media 16. Where the die 46 includes a plurality of portions 48, the media 16 will comprise a plurality of embossed portions 20.

The embosser 26 is arranged to provide the embossed media 16 to a user of the printing system 10 and may, for example, provide the embossed media 16 to a tray for collection by a user. In other examples, the embosser 26 may provide the embossed media 16 to a further component (not illustrated) of the apparatus 141 or of the printing system 10.

The controller 22 is arranged to control the operation of the embosser 26. For example, where the embosser 26 includes opposing pressure rollers, the controller 22 may control the rotation of the pressure rollers.

The apparatus 141 may advantageously be used to emboss small quantities of media 16 at a relatively low cost because the cutter apparatus 24 is able to produce a suitable die 46 from the multi-layer substrate 38 on an ad-hoc basis. This may render the apparatus 141 suitable for use in a digital printing system.

Figure 3:
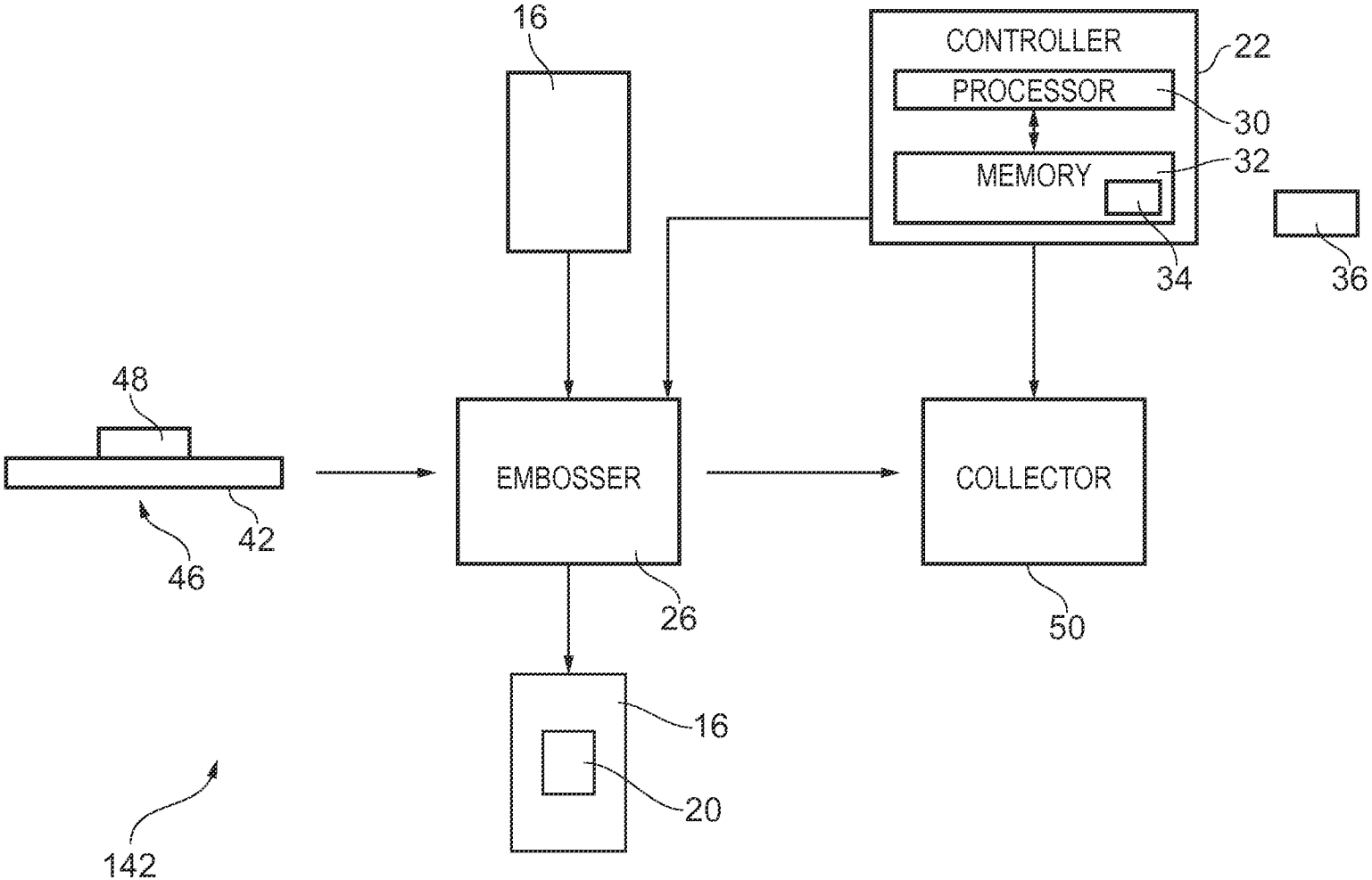
FIG. 3 illustrates a schematic diagram of another apparatus for embossing media according to an example.

FIG. 3 illustrates a schematic diagram of another apparatus 142 for embossing media according to an example. The apparatus 142 is similar to the apparatus 141 and where the features are similar, the same reference numerals are used.

The apparatus 142 includes a controller 22, an embosser 26 and a collector 50. The apparatus 142 may be a unitary device whereby the controller 22, the embosser 26 and the collector 50 are housed in a housing (not illustrated) and form a standalone device that may be connected to the printer 12. In other examples, a housing may house both the apparatus 142 and the printer 12. In further examples, the apparatus 142 may be a module and may not include, for example, the controller 22.

As described in the preceding paragraphs with reference to FIG. 2, the embosser 26 is arranged to emboss media 16 using a die 46 formed from a multi-layer substrate 38.

The collector 50 is arranged to remove and collect the die 46 from the embosser 26 after the die 46 has been used by the embosser 26 to emboss the media 16. The collector 50 may remove the die 46 after the die 46 has been used by the embosser 26 a single time, or a plurality of times. The collector 50 may be any suitable collector for the die 46. For example, the collector 50 may include a roller on which the die 46 may be rolled and stored. In other examples, the collector 50 may include a container for storing the die 46.

The controller 22 is arranged to control the operation of the collector 50. For example, where the collector 50 includes a roller, the controller 22 may control the rotation of the roller. The controller 22 may control the collector 50 to remove the die 46 from the embosser 26 using data defining another shape to be cut. For example, the controller 22 may receive shape data from a user or from the memory 32 for the creation of a new die and in response to the shape data, the controller 22 controls the collector 50 to remove the die 46 from the embosser 26 to enable the new die to enter the embosser 26.

The apparatus 142 provides an advantage in that the collector 50 is able to remove a die from the embosser 26 to enable a new die, having a different shape, to enter the embosser 26. This may be advantageous in a digital printing system where the embossing shape may change over a printing session.

Figure 4:
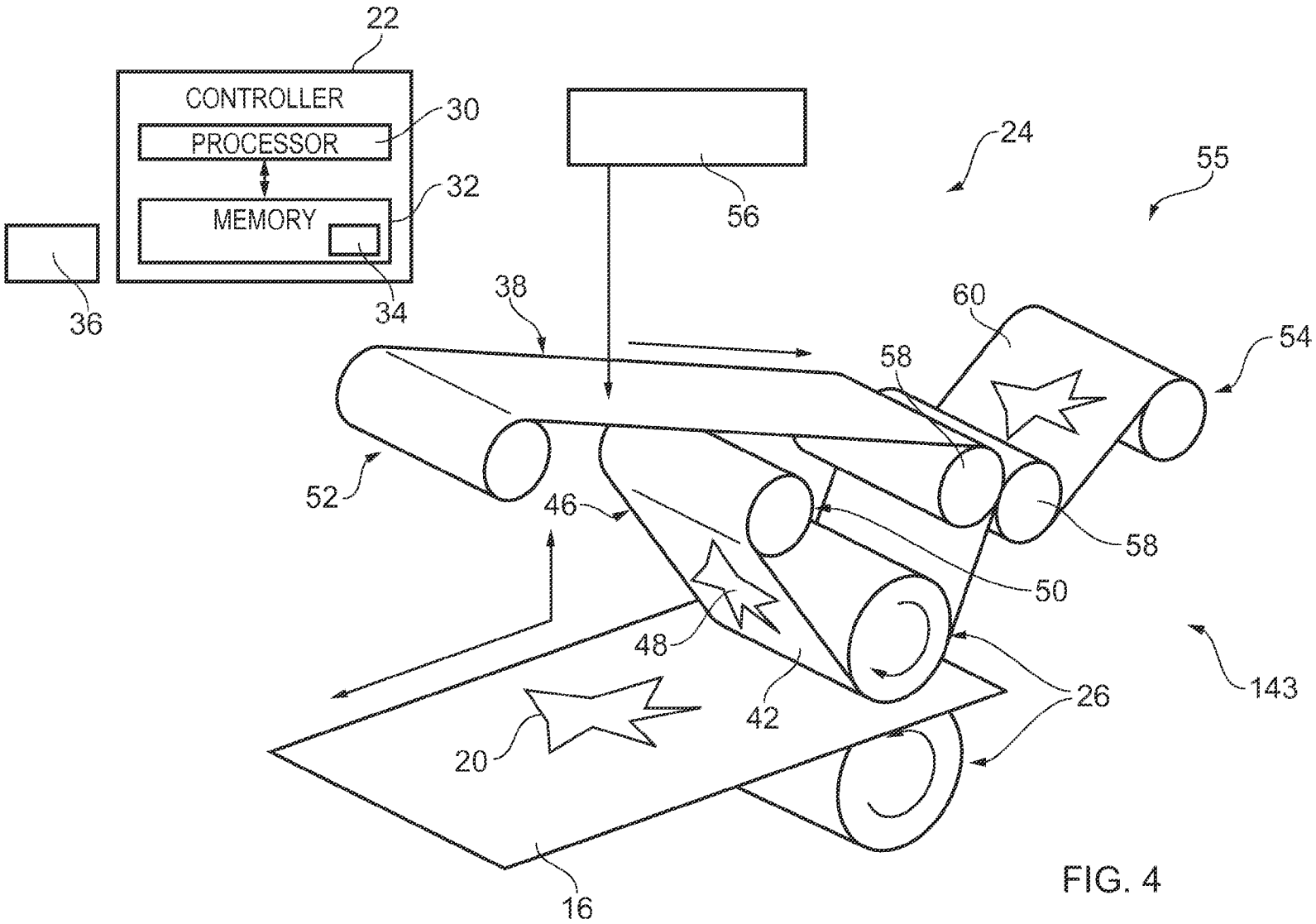
FIG. 4 illustrates a perspective view diagram of a further apparatus for embossing media according to an example.

FIG. 4 illustrates a perspective view diagram of a further apparatus 143 for embossing media according to an example. The apparatus 143 is similar to the apparatus 141 and the apparatus 142 and where the features are similar, the same reference numerals are used.

The apparatus 143 includes a controller 22, a dispenser 52, a cutter apparatus 24, a first collector 54, an embosser 26 and a second collector 50. The apparatus 143 may be a unitary device whereby the controller 22, the dispenser 52, the cutter apparatus 24, the first collector 54, the embosser 26 and the second collector 50 are housed in a housing (not illustrated) and form a standalone device that may be connected to the printer 12. In other examples, a housing may house both the apparatus 142 and the printer 12. In further examples, the apparatus 143 may be a module and may not include, for example, the controller 22.

The controller 22 is arranged to control the operation of the cutter apparatus 24, the first collector 54, the embosser 26 and the second collector 50. Control lines from the controller 22 are not illustrated in FIG. 4 to maintain the clarity of FIG. 4.

The dispenser 52 includes a roller having a web of multi-layer substrate 38 wound thereon. In some examples, the dispenser 52 may be arranged to dispense sheets of multi-layer substrate 38 rather than a web of multi-layer substrate 38. In these examples, the sheets of multi-layer substrate 38 may be placed on a conveyer belt to move them within the apparatus 143.

The cutter apparatus 24 includes a laser 56 for cutting a shape into the multi-layer substrate 38 (a star shape portion 48 as illustrated in FIG. 4) and also includes opposing rollers 58 for controlling the movement of the multi-layer substrate 38 (for example, by providing the multi-layer substrate 38 to the embosser 26). In some examples, the laser 56 is arranged to operate in a plurality of different modes to achieve different forms of die 46. For example, the different modes of the laser 56 may be used to produce dies that achieve different effects such as embossing, creasing, texturing and so on.

The first collector 54 includes a roller for removing the portion 60 of the first layer 40 of the multi-layer substrate 38 after the multi-layer substrate 38 has been cut by the laser 56 and prior to the embosser 26 embossing the media 16. As illustrated in FIG. 4, the portion 60 is the first surface 40 of the multi-layer substrate 38 which has a star shaped cut-out.

As described above, the cutter apparatus 24 and the first collector 54 may be referred to as a 'die former' 55 that is arranged to selectively remove the portion 60 of the first layer 50 of the multi-layer substrate 38 to form the die 46.

The embosser 26 includes opposing pressure rollers that define a nip there between. The apparatus 143 is arranged so that media 16 is fed between the nip of the opposing pressure rollers 26 together with the die 46. The die 46, with pressure applied by the opposing pressure rollers 26, embosses the media 16 so that the media 16 has a star shaped embossed portion 20 corresponding to the star shaped portion 48 of the die 46. In some examples, one of the opposing pressure rollers 26 is resilient and may comprise a rubber outer layer for example.

The second collector 50 includes a roller for receiving the die 46 from the embosser 26 and for storing the die 46. The controller 22 is arranged to control the operation of the second collector 50 by controlling rotation of the roller so that the die 46 is drawn from the embosser 26 and wound around the roller.

The operation of the apparatus 143 is described in the following paragraphs with reference to FIG. 5.

Initially, the apparatus 143 may be set up for use. In particular, a user may pull a length of multi-layer substrate 38 from the dispenser 52, move the substrate 38 through the opposing rollers 58 of the cutter apparatus 24, remove the first layer 40 and the adhesive 44 from the substrate 38 and wrap them around the first collector 54, move the second layer 42 through the opposing pressure rollers of the embosser 26 and then wrap the second layer 42 around the second collector 50.

At block 62, the controller 22 receives data defining the shape to be cut by the cutter apparatus 24. For example, the controller 22 may receive the data from a user input device or may receive the data from the memory 32.

At block 64, the controller 22 controls the cutter apparatus 24 to cut the shape (defined by the received data) in the first layer 40 of the multi-layer substrate 38 to form the die 46. The controller 22 also controls the opposing rollers 58 to rotate and thereby move the die 46 to the embosser 26.

At block 66, the controller 22 controls the first collector 54 to remove the portion 60 from the multi-layer substrate 38. In particular, the controller 22 controls the roller of the first collector 54 to rotate so that the portion 60 is peeled from the second layer 42 and wound around the roller.

The combination of blocks 64 and 66 may be also be considered to form a single block in which the controller 22 controls the die former 55 to selectively remove the portion 60 of the surface layer 40 of the multi-layer substrate 38 to form the die 46.

At block 68, the controller 22 controls the embosser 26 (which may also be referred to as a pressure applicator) to emboss the media 16 using the die 46. In particular, the controller 22 controls the opposing pressure rollers to rotate so that the die 46 and the media 16 are moved through the nip together.

If the embossing shape is to be repeated for another sheet of media 16 or for a further section of a web of media 16, the controller 22 controls the opposing pressure rollers of the embosser 26 to move away from one another (that is, to increase the size of the nip) and controls the opposing rollers 58 of the cutter apparatus 24 to rotate in an opposite direction so that the die 46 is moved back through the nip between the opposing pressure rollers of the embosser 26 so that the die 46 may be re-used. The controller 22 then controls the opposing pressure rollers of the embosser 26 to move toward one another to decrease the size of the nip. Block 68 may then be repeated. Consequently, the apparatus 143 provides an advantage in that the die 46 may be used repeatedly according to a user's needs. For example, where the die 46 is formed on a web of multi-layer substrate 38, the web can be driven back and forth through the embosser 26 as described above.

At block 70, the controller 22 controls the second collector 50 to remove the die 46 from the embosser 26 after the die 46 has been used by the embosser 26 to emboss the media 16. In particular, the controller 22 controls the roller of the second collector 50 to rotate and thereby collect the die 46 around the roller. In some examples, the controller 22 may control the second collector 50 to remove the die 46 in response to receiving data defining a new shape to be cut by the cutter apparatus 24.

Figure 5:
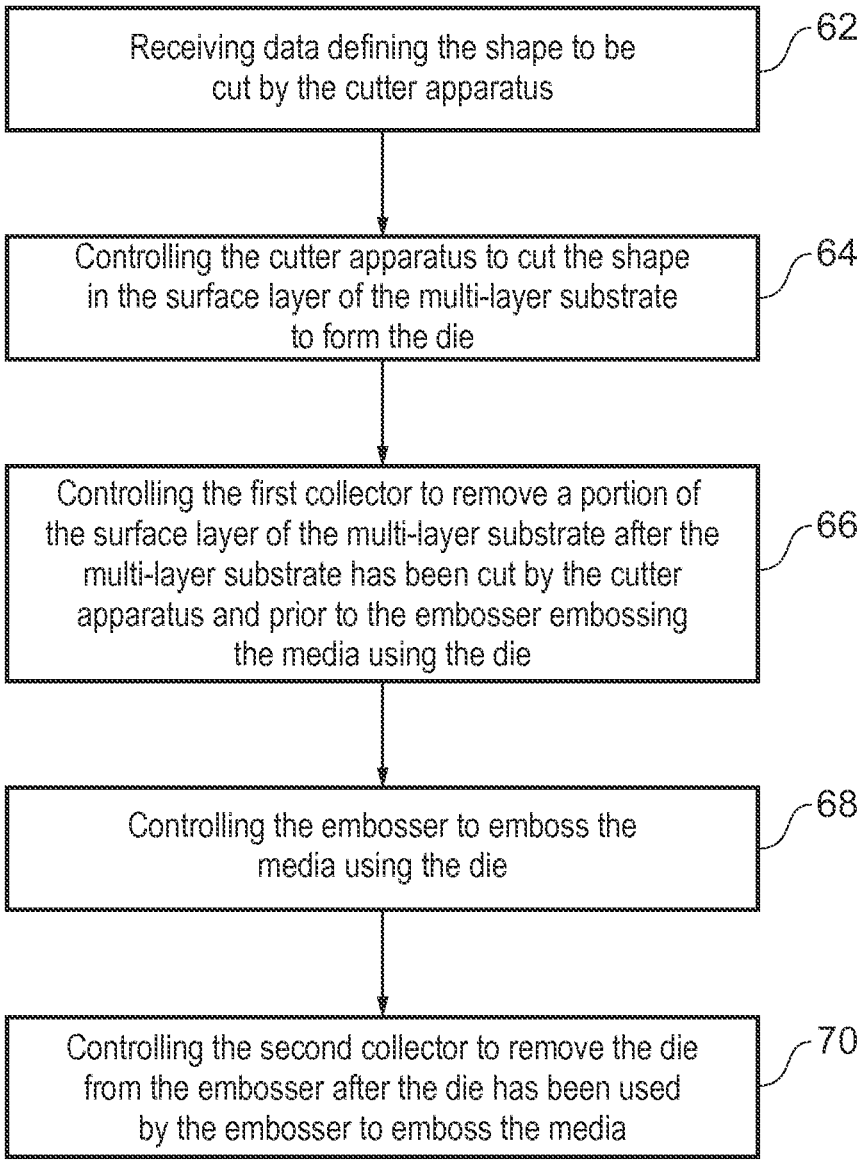
FIG. 5 illustrates a flow diagram of a method of controlling an apparatus for embossing media according to an example.

The blocks illustrated in the FIG. 5 may represent steps in a method and/or sections of code in the computer program 34. The illustration of a particular order to the blocks does not necessarily imply that there is a required or preferred order for the blocks and the order and arrangement of the block may be varied. Furthermore, it may be possible for some blocks to be omitted. In some examples, at least some of the blocks may be performed simultaneously. For example, blocks 64, 66, 68 and 70 may be performed simultaneously to enable a web of multi-layer substrate to be moved within the apparatus.

The term 'comprise' is used in this document with an inclusive not an exclusive meaning. That is, any reference to X comprising Y indicates that X may comprise only one Y or may comprise more than one Y. If it is intended to use 'comprise' with an exclusive meaning then it will be made clear in the context by referring to "comprising only one . . . " or by using "consisting".

In this description, reference has been made to various examples. The description of features or functions in relation to an example indicates that those features or functions are present in that example. The use of the term 'example' or 'for example' or 'may' in the text denotes, whether explicitly stated or not, that such features or functions are present in at least the described example, whether described as an example or not, and that they can be, but are not necessarily, present in some of or all other examples. Thus 'example', 'for example' or 'may' refers to a particular instance in a class of examples. A property of the instance can be a property of only that instance or a property of the class or a property of a sub-class of the class that includes some but not all of the instances in the class.

Although examples of the present invention have been described in the preceding paragraphs, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain examples, those features may also be present in other examples whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus for embossing media, the apparatus comprising:

a cutter apparatus to cut a shape in a surface layer of a multi-layer substrate to form a die;

an embosser to emboss the media using the die, the cutter apparatus being arranged to provide the die to the embosser;

a second collector to remove the die from the embosser after the die has been used by the embosser to emboss the media; and a controller to control the second collector to remove the die from the embosser using data defining another shape to be cut.

2. The apparatus as claimed in claim 1, wherein the cutter apparatus comprises a laser.

3. The apparatus as claimed in claim 2, wherein the laser is arranged to operate in a plurality of different modes to achieve different forms of die.

4. The apparatus as claimed in claim 1, further comprising a first collector to remove a portion of the surface layer of the multi-layer substrate after the multi-layer substrate has been cut by the cutter apparatus and prior to the embosser embossing the media using the die.

5. The apparatus as claimed in claim 1, further comprising a dispenser to store a web of the multi-layer substrate.

6. The apparatus as claimed in claim 1, wherein the embosser is arranged to repeatedly use the die to emboss media.

7. The apparatus as claimed in claim 1, wherein the apparatus is a unitary device and further comprises a housing to house the cutter apparatus and the embosser.

8. The apparatus as claimed in claim 1, wherein the apparatus is part of a printing system.

9. A method of controlling an apparatus for embossing media, the method comprising:

controlling a die former to selectively remove a portion of a surface layer of a multi-layer substrate to form a die; and controlling a pressure applicator to emboss the media using the die, the die former being arranged to provide the die to the pressure applicator; and controlling a second collector to remove the die from the embosser after the die has been used b the embosser to emboss the media is performed using data defining another shape to be cut.

10. The method as claimed in claim 9, further comprising receiving data defining a shape to be cut in the multi-layer substrate, and wherein controlling the die former is performed using the received data.

11. The method as claimed in claim 9, wherein controlling the die former comprises controlling a first collector to remove a portion of the surface layer of the multi-layer substrate after the multi-layer substrate has been cut by the die former and prior to the embosser embossing the media using the die.

12. The method as claimed in claim 9, further comprising controlling the removal of the multi-layer substrate from a dispenser.

13. The method as claimed in claim 12, wherein the die former comprises a laser arranged to operate in a plurality of different modes to achieve different forms of die, the method further comprising controlling the mode of the laser.

14. The method as claimed in claim 12, further comprising controlling the pressure applicator to repeatedly use the die to emboss media.

* * * * *

UNITED STATES PATENT AND TRADEMARK OFFICE

CERTIFICATE OF CORRECTION

PATENT NO. : 9,038,534 B2
APPLICATION NO. : 13/715379
DATED : May 26, 2015
INVENTOR(S) : Ziv Gilan et al.

It is certified that error appears in the above-identified patent and that said Letters Patent is hereby corrected as shown below:

Claims

In column 8, line 36, in Claim 9, delete "b" and insert -- by --, therefor.

Signed and Sealed this
Twenty-first Day of June, 2016

Michelle K. Lee

Michelle K. Lee
*Director of the United States Patent and Trademark Office*